US005417573A

United States Patent [19]

Cassiere, II et al.

[11] Patent Number: 5,417,573

[45] Date of Patent: May 23, 1995

[54] REACTION TIME ENHANCER FOR TRAINING FIREARM AIMING

[76] Inventors: Joseph L. Cassiere, II, 3504 Cuba Rd., Monroe, La. 71201; Stephen G. Cassiere, 530 N. Hampton, Shreveport, La. 71106

[21] Appl. No.: 150,000

[22] Filed: Nov. 12, 1993

[51] Int. Cl.[6] ..... F41G 3/26

[52] U.S. Cl. ..... 434/21; 434/19

[58] Field of Search ..... 434/21, 19, 16, 11, 434/258; 362/800, 234, 252

[56] References Cited

U.S. PATENT DOCUMENTS

| | | | |
|---|---|---|---|
| 1,758,179 | 5/1930 | Snavely | 362/252 X |
| 1,803,064 | 4/1931 | Karnes et al. | 434/19 |
| 2,137,161 | 11/1938 | Grantham | 362/252 |
| 2,553,906 | 5/1951 | Ferguson | 362/252 |
| 2,995,834 | 8/1961 | Rowe . | |
| 4,261,563 | 4/1981 | Goldfarb . | |
| 4,533,144 | 8/1985 | Juarez et al. . | |
| 4,854,595 | 8/1989 | Eichweber . | |
| 5,309,334 | 5/1994 | Willison | 362/252 X |

*Primary Examiner*—Gene Mancene
*Assistant Examiner*—Jeffrey A. Smith
*Attorney, Agent, or Firm*—John M. Harrison

[57] ABSTRACT

A reaction time enhancer for gradually decreasing a user's reaction time in aiming a shotgun at clay pigeons in trap shooting and other clay target sports, through repeated use. In a preferred embodiment the "T"-shaped reaction time enhancer is characterized by a horizontal rectangular bar provided with a shorter, vertical rectangular bar perpendicularly mounted on the bottom surface of the horizontal bar. A green lamp is provided on the vertical bar and seven spaced orange lamps are provided on the horizontal bar. The vertical bar contains a suitable electronic circuit which can operate the lamps in one of two different modes. In the first mode, which simulates singles trap shooting, a user initially aims a shotgun at the illuminated green lamp, then as quickly as possible, transfers his aim to a randomly-illuminated orange lamp. In the second mode, which simulates doubles trap shooting, the user aims the shotgun at the illuminated green lamp then as quickly as possible transfers his aim to a randomly-illuminated orange lamp as in the first mode, but then a second orange lamp is randomly illuminated and the user immediately transfers his aim from the first, extinguished orange lamp to the second, illuminated orange lamp.

7 Claims, 1 Drawing Sheet

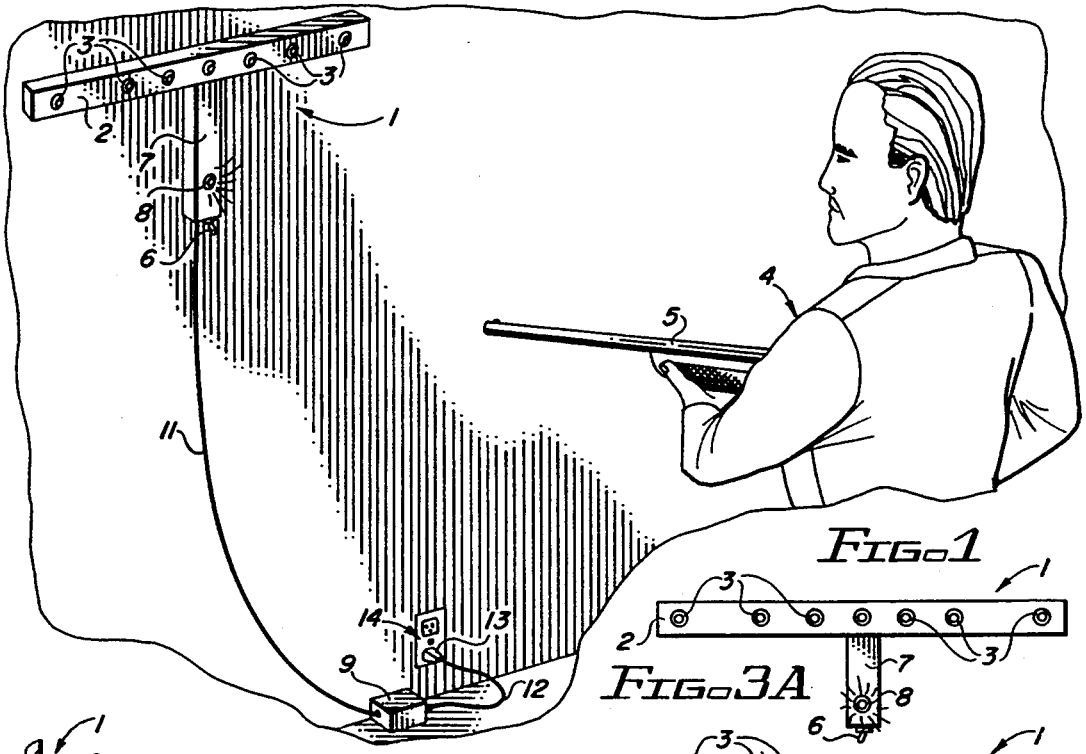
FIG. 1
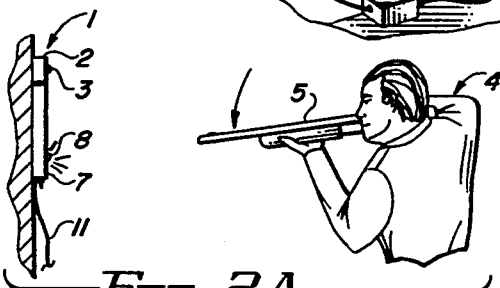
FIG. 2A
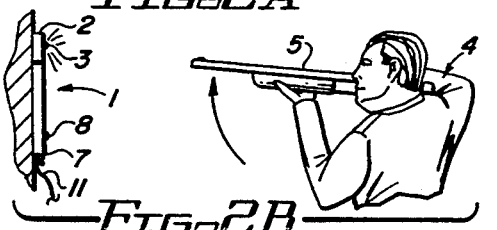
FIG. 2B
FIG. 3A
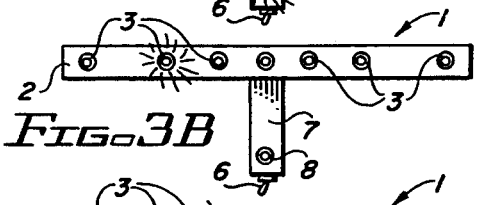
FIG. 3B
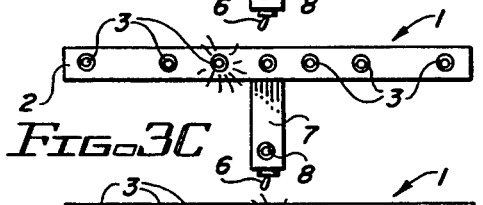
FIG. 3C
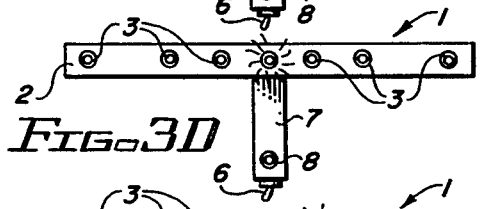
FIG. 3D
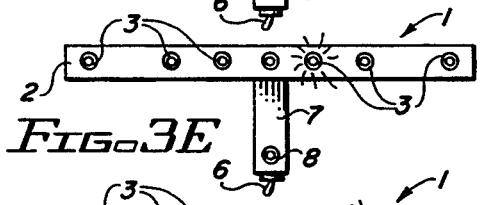
FIG. 3E
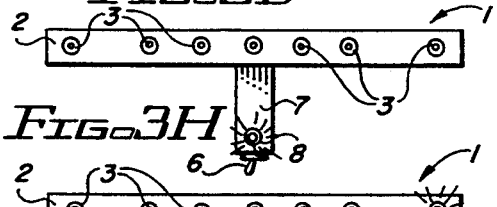
FIG. 3H
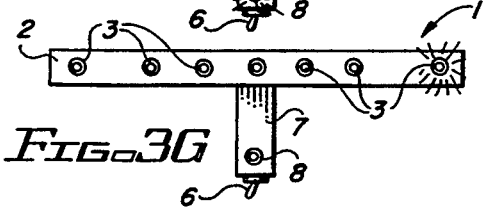
FIG. 3G
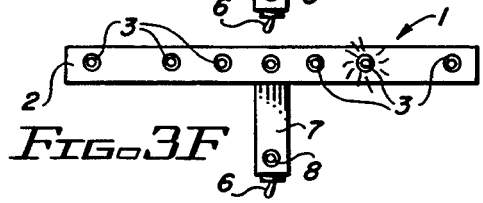
FIG. 3F

REACTION TIME ENHANCER FOR TRAINING FIREARM AIMING

BACKGROUND OF THE INVENTION

1. Field of the Invention

This invention relates to devices for decreasing a shooter's reaction time in aiming a gun at a flying clay pigeon or pigeons in trap shooting and other clay target sports and more particularly, to a T-shaped reaction time enhancer which is characterized by an elongated, horizontal bar provided with a shorter, vertical bar attached to the bottom surface of the horizontal bar. In a preferred embodiment the reaction time enhancer includes a green lamp mounted on the front surface of the vertical bar and seven spaced orange lamps mounted on the front surface of the horizontal bar. The vertical bar houses an electrical circuit which is suitably adapted for illuminating the lamps in one of two different modes, the first of which simulates shooting singles handicap trap shooting and the other, doubles trap shooting.

Trap shooting is conventionally conducted at several stations positioned behind a "trap house", which encloses a trap-throwing gun that throws clay pigeons from the trap house. The clay pigeons are thrown from the trap house as singles or doubles in random directions, ranging from far left to far right and at various angles in between and rise at these angles away from the shooter. In singles trap shooting, a shooter typically first aims his or her shotgun at the top center of the trap house, a clay pigeon is thrown from the trap house in a random direction and the shooter, as quickly as possible, transfers his aim from the trap house to lead or point and shoot the clay pigeon. In doubles trap shooting, a first clay pigeon is thrown from the trap house in a random direction as in the singles trap procedure, and either simultaneously or shortly thereafter, a second clay pigeon is thrown from the trap house in a random direction. The shooter shoots the first clay pigeon, then as quickly as possible, aims at and shoots the second clay pigeon. The orange lamps of the reaction time enhancer of this invention simulate various possible random positions of a thrown clay pigeon relative to the top center of the trap house, which is simulated by the green lamp. A user mounts the reaction time enhancer on a wall, chooses a single or double trap shooting mode and stands at a distance of about four feet from his or her eyes, to the wall. In the first, or singles, trap shooting mode the user initially aims a gun at the green lamp, which is illuminated for about ten seconds. The green lamp is then automatically extinguished and simultaneously, one of the orange lamps is randomly illuminated for about three seconds. The user then immediately transfers his aim from the extinguished green lamp to the illuminated orange lamp. After the orange lamp is extinguished, the green lamp is again illuminated and the user returns his aim to the green lamp. In the second, or doubles trap shooting mode, the user first aims at the green lamp and then at a randomly-illuminated orange lamp, as in the first mode, but a second orange lamp is randomly illuminated at the same time the first orange lamp is extinguished, and the user as quickly as possible transfers his or her aim from the first, extinguished orange lamp to the second, illuminated orange lamp. The second orange lamp is then extinguished as the green lamp is again illuminated. Instead of aiming at the lamps using a gun, the user may point with a hand and finger or hold the enhancer by the stem of the "T" in the right hand at arm's length and observe the various lamps as they are illuminated. Through repeated use of the reaction time enhancer, a user can significantly decrease his or her reaction time in aiming a shotgun at a flying clay pigeon or game bird.

2. Description of the Prior Art

Various devices for decreasing a shooter's reaction time to a rapidly-moving target such as a clay pigeon, are known in the art. U.S. Patent No. 2,995,834, dated Aug. 15, 1961, to Carl B. Rowe, describes a "Wing-Shot Training Device", characterized by a stationary projector which projects and moves a spot of light on a screen to simulate the flight of a bird or a clay pigeon. A gun provided with a spot projector is used by the shooter, who aims the gun at the target spot produced by the stationary projector and pulls the trigger so that the spot projector illuminates a spot on the screen. If the "fired" spot lies in part on the target spot, the gunner has scored a hit. U.S. Pat. No. 4,261,563, dated Apr. 14, 1981, to Adolph E. Goldfarb, discloses an "Electronic Time Reaction Game Apparatus" characterized by a rectangular housing which includes a pair of opposed player-ends and a microprocessor powered by a battery. Multiple, spaced player response lights are longitudinally disposed on each player-end. The microprocessor generates a "player ready" signal and, after a time interval of random length, initiates a "player start" signal. Each player then attempts to anticipate the opponent's action and as quickly as possible, selects and presses the appropriate one of two response buttons provided on each player-end, energizing one of the response lights and generating a score. U.S. Pat. No. 4,533,144, dated Aug. 6, 1985, to Manual Juarez, et al., details an "Electronic Game", in which multiple target lamps are individually transiently energized by timing circuitry. Hazard weapons, which are interspersed among the target lamps and are actuated by timing circuitry, emit infrared beams at a participant standing within a player zone in front of the target lamps. The participant fires a target weapon at an energized target lamp, generating points indicated on a digital display when a photosensor on the target weapon detects accurate aiming of the target weapon on the energized target lamp at the same time the trigger is pulled. The game is terminated when the participant has expended all of the allotted shots at the targets or when the infrared beam from an activated hazard weapon is intercepted by the body of the game participant. U.S. Pat. No. 4,854,595, dated Aug. 8, 1989, to Kurt Eichweber, describes a "Firearm Aiming Simulator Device" for practice in aiming a firearm at a target. The device includes an optical aiming system for aiming a laser beam at a target, which is provided with several different groups of reflectors for reflecting the laser beam and allowing determination of the laser beam striking point. U.S. Pat. No. 4,963,096, dated Oct. 16, 1990, to Anwar S. Khattak, et al details a "Device and Method for Improving Shooting Skills", characterized by a laser diode or a light-emitting diode which shoots a laser or light beam through a collimating lens and a hollow shaft, and then to a prism rotated by a motor. The revolving prism forms a substantially circular reflecting image. When a shooter aims at a moving clay pigeon target, the shooter moves the gun barrel through a sweeping line of sight along the target flight path until the moving target intersects a point on the circumference of the circular reflecting image, thus indicating to the shooter that a proper lead has been achieved for successfully shooting the moving target. In addition to the devices described above, various diagrams for practice in quickly aiming a gun at a moving target such as a clay pigeon, are known in the art.

It is an object of this invention to provide a reaction time enhancer for decreasing a user's reaction time in aiming a gun at moving targets such as clay pigeons or targets in trap shooting and other clay target sports, which reaction time enhancer is characterized by a "T"-shaped structure including multiple, spaced, orange lamps provided on the front surface of a horizontal bar and a single green lamp provided on the front surface of a vertical bar mounted on the bottom surface of the horizontal bar, the vertical bar containing an electrical circuit suitable for selectively operating the lamps in a first mode for simulating singles trap shooting and a second mode for simulating doubles trap shooting.

It is another object of this invention to provide a "T"-shaped reaction time enhancing device which incorporates a suitable electrical circuit for operating multiple, horizontally-spaced orange lamps and a single green lamp in a mode for simulating singles trap shooting and other clay target sports, in which the green lamp is initially illuminated for a few seconds, the shooter aims a shotgun at the green lamp, the green lamp is then extinguished and simultaneously, one of the seven orange lamps is randomly illuminated, the shooter as quickly as possible then transfers his aim from the extinguished green lamp to the illuminated orange lamp, the orange lamp is then extinguished and the green lamp is again illuminated, and the user finally returns his aim to the green lamp.

It is still another object of this invention to provide a reaction time enhancer which includes a conventional electrical circuit for operating seven horizontally-spaced orange lamps and a single green lamp in a mode for simulating doubles trap shooting, in which the green lamp is first illuminated for a few seconds, the user/-shooter aims a shotgun at the green lamp, the green lamp is then extinguished and simultaneously one of the seven orange lamps is randomly illuminated, the user/-shooter then, as quickly as possible, transfers his or her aim from the extinguished green lamp to the illuminated orange lamp, the orange lamp is extinguished and a second orange lamp is simultaneously randomly illuminated, the user/shooter then immediately transfers his or her aim from the first, extinguished orange lamp to the second illuminated orange lamp, the second orange lamp is then extinguished, the green lamp is again illuminated and the user/shooter returns his or her aim to the illuminated green lamp.

SUMMARY OF THE INVENTION

These and other objects of the invention are provided in a T-shaped reaction time enhancer which through repeated use gradually decreases a shooter's reaction aiming time to a flying clay pigeon or game bird, and in a preferred embodiment includes multiple, spaced orange lamps located on the anterior surface of a horizonal rectangular bar, a unitary green lamp located on the anterior surface of a vertical rectangular bar which is perpendicularly mounted on the bottom surface of the horizontal bar and an electrical circuit which is housed in the vertical bar and is suitably adapted for operating the lamps in one of two modes, the first mode for simulating singles trap shooting, in which the green lamp is initially illuminated for a few seconds, the user aims a shotgun at the green lamp, the green lamp is extinguished and simultaneously one of the seven orange lamps is randomly illuminated for a few seconds, the user as quickly as possible transfers his or her aim from the extinguished green lamp to the illuminated orange lamp, the orange lamp is extinguished and the green lamp is again illuminated, and the user returns his or her aim to the green lamp; in the second mode for simulating doubles trap shooting, the green lamp is initially illuminated for a few seconds, the user aims a gun at the green lamp, the green lamp is then extinguished and simultaneously one of the seven orange lamps is randomly illuminated for a few seconds, the user as quickly as possible transfers his or her aim from the extinguished green lamp to the illuminated orange lamp, the orange lamp is extinguished and a second orange lamp is simultaneously randomly illuminated for a few seconds, the user immediately transfers his or her aim from the first, extinguished orange lamp to the second, illuminated orange lamp, the second orange lamp is then extinguished, the green lamp is again illuminated and the user returns his or her aim to the illuminated green lamp.

BRIEF DESCRIPTION OF THE DRAWING

The invention will be better understood by reference to the accompanying drawing, wherein:

FIG. 1 is a perspective view of a preferred embodiment of the reaction time enhancer of this invention, with a user/shooter in position to use the reaction time enhancer, as the bottom light is illuminated;

FIG. 2A is a side view of the reaction time enhancer and shooter illustrated in FIG. 1;

FIG. 2B is a side view of the reaction time enhancer and the shooter, illustrating illumination of one of the upper orange lamps and response by the user/shooter;

FIG. 3A is a front view of the reaction time enhancer illustrating initiation of a selected mode cycle by illumination of the bottom lamp;

FIG. 3B is a front view of the reaction time enhancer illustrating illumination of the second upper lamp from the left;

FIG. 3C is a front view of the reaction time enhancer illustrating illumination of the third upper lamp from the left;

FIG. 3D is a front view of the reaction time enhancer illustrating illumination of the fourth upper lamp from the left;

FIG. 3E is a front view of the reaction time enhancer illustrating illumination of the fifth upper lamp from the left;

FIG. 3F is a front view of the reaction time enhancer illustrating illumination of the sixth upper lamp from the left;

FIG. 3G is a front view of the reaction time enhancer illustrating illumination of the seventh upper lamp from the left; and FIG. 3H is a front view of the reaction time enhancer of this invention, illustrating initiation of another mode cycle by illumination of the bottom lamp.

DESCRIPTION OF THE PREFERRED EMBODIMENTS

Referring initially to FIG. 1 of the drawing, the reaction time enhancer of this invention is generally illustrated by reference numeral 1. In a preferred embodiment the reaction time enhancer 1 includes an elongated, hollow, rectangular horizontal bar 2, constructed of aluminum or stainless steel. Seven spaced lamps 3, each having a common color such as orange and preferably characterized by a light-emitting diode (not illustrated), are mounted on the anterior surface of the horizontal bar 2. The horizontal bar 2 is provided with a shorter, rectangular vertical bar 7, mounted on the bottom surface of the horizontal bar 2 at substantially the midpoint thereof. A single lamp 8, also having a selected color such as green and preferably characterized by a light-emitting diode (not illustrated), is provided near the lower edge of the anterior surface of the vertical bar 7. A conventional electrical circuit (not illustrated), housed within the horizontal bar 2 and vertical bar 7, is powered by a power converter 9, which receives a standard outlet cord 12, provided with a cord plug 13 on the end. The cord plug 13 plugs into a conventional household electric outlet 14, as illustrated. A direct current power cord 11, which is wired to the power converter 9, enters the bottom surface of the vertical bar 7 and is wired into the electrical circuit. The electrical circuit is also wired to the light-emitting diode of each orange lamp 3 and to the green lamp 8. Accordingly, alternating current is supplied from the electrical outlet 14 to the power converter 9, where it is converted to direct current for delivery through the direct current power cord 11, to the reaction time enhancer 1.

Referring now to FIGS. 3A–3H, the electrical circuit operates the green lamp 8 and the orange lamps 3 in one of two different modes. In the first mode, which simulates singles trap shooting, the green lamp 8 is first illuminated for approximately seven seconds, as illustrated in FIG. 3A. The green lamp 8 is then extinguished and simultaneously, one of the seven orange lamps 3 is randomly illuminated for about two seconds, for example, any one of the first through the seventh orange lamps 3 from the left, as illustrated in FIGS. 3B–3G. The randomly illuminated orange lamp 3 is then extinguished and the green lamp 8 is again illuminated for about seven seconds, as illustrated in FIG. 3H. Another cycle is thus initiated. In the second mode, which simulates doubles trap shooting, the green lamp 8 is first illuminated for approximately seven seconds, as illustrated in FIG. 3A. The green lamp 8 is then extinguished and one of the orange lamps 3 is randomly illuminated for about two seconds, for example, the third orange lamp 3 from the left, as illustrated in FIG. 3C. This orange lamp 3 is then extinguished and another orange lamp 3, for example, the seventh orange lamp 3 from the left, as illustrated in FIG. 3G, is simultaneously illuminated for about two seconds. This orange lamp 3 is then extinguished and the green lamp 8 is simultaneously illuminated, as illustrated in FIG. 3H, and the cycle repeats.

Referring now to FIGS. 1–3H, the reaction time enhancer 1 is energized by plugging the cord plug 13 into the electrical outlet 14, as illustrated in FIG. 1. The desired singles or doubles mode is then selected by moving the toggle switch 6 to the appropriate position. In the first mode, a user/shooter 4 first aims a shotgun 5 at the green lamp 8, which is illuminated for about seven seconds, as illustrated in FIGS. 1,2A and 3A. The green lamp 8 is then automatically extinguished and simultaneously, one of the orange lamps 3, such as the third orange lamp 3 from the left as illustrated in FIG. 3C, is randomly illuminated for about two seconds. The user 4 as quickly as possible then transfers his aim from the extinguished green lamp 8 to the illuminated orange lamp 3, as illustrated in FIG. 2B. This orange lamp 3 is then extinguished and the green lamp 8 is again illuminated for approximately seven seconds, as illustrated in FIG. 3H. Another cycle is thus initiated and the user 4 returns his aim of the shotgun 5 to the green lamp 8. In the second mode, the user 4 first aims the shotgun 5 at the green lamp 8, which is illuminated for about seven seconds, as in the first mode. The green lamp 3 is then extinguished and one of the seven orange lamps 3 is randomly illuminated for about two seconds, for example, the second orange lamp 3 from the left, as illustrated in FIG. 3B. The user 4 then as quickly as possible, transfers his aim from the extinguished green lamp 8 to the illuminated orange lamp 3, as illustrated in FIG. 2B. The second orange lamp 3 from the left is then extinguished and another orange lamp 3 is simultaneously randomly illuminated for about two seconds, for example, the seventh orange lamp 8 from the left, as illustrated in FIG. 3G. The user 4 then as quickly as possible transfers his aim of the shotgun 5 from the extinguished second orange lamp 3 from the left to the illuminated seventh orange lamp 3 from the left. The seventh orange lamp 3 from the left is then extinguished and the green lamp 8 is again illuminated for about seven seconds, as illustrated in FIG. 3H, beginning another cycle.

It will be appreciated by those skilled in the art of clay target shooting that the reaction time enhancer 1 of this invention is light in weight and portable, and as such, can be easily carried and used in any location where electrical power or a portable power generator is available. The reaction time enhancer 1 may be affixed to a wall by using Velcro, loop-pile fastener, or a suitable hanger (not illustrated) or it may be held at arms length during eye exercises without aiming the shotgun 5. The reaction time enhancer is designed exclusively for gradually decreasing a shooter's reaction time through repeated use and is not a game, unlike previous devices known in the art. In addition to decreasing a shooter's reaction time in aiming a shotgun to break clay pigeons in trap shooting, the reaction time enhancer 1 can also be used to enhance a hunter's reflexes to aim and shoot flying pheasant, ducks, dove, quail, geese and other game birds. Since the reaction time enhancer 1 utilizes no infrared beams or laser beams, the use of complex and expensive electronic circuits which characterize such devices is not necessary. Conventional circuits such as those used to randomly illuminate Christmas tree lights may be used, as desired. For example, conventional "off the shelf" microchips can be selected and assembled on a printed circuit board and a suitable microcode developed by a programmer to correspond to the microchips in order to illuminate the green lamp 8 and orange lamps 3 as described herein. The illumination duration of the orange lamps 3 and green lamp 8 of the reaction time enhancer 1 may be adjusted, depending upon the circuit design. The green lamp 8 and orange lamps 3 may be provided in any contrasting colors and may be incandescent in design or light-emitting diodes, by way of example. To access the electrical circuit, a rear panel (not illustrated) provided on the reaction time enhancer may be removed by removing fasteners such as screws (also not illustrated). Accordingly, it is understood that any electrical circuit which is capable of effecting initial illumination of the green lamp 8 and random illumination of the orange lamps 3 may be employed in the reaction time enhancer 1, according to the knowledge of those skilled in the art.

Accordingly, while the preferred embodiments of the invention have been described above, it will be recognized and understood that various modifications can be made without departing from the spirit and scope of the invention.

Having described my invention with the particularity set forth above, what is claimed is:

1. A reaction time enhancer for decreasing a user's reaction time in aiming a firearm at a moving target, comprising frame means disposed in spaced relationship with respect to the firearm; a single lamp carried by said frame means, said single lamp having a first selected color; and a plurality of lamps carried by said frame means above said, single lamp, said lamps each having a second selected color, whereby the aim of the firearm is transferred by the user from said single lamp to a selected one of said lamps responsive to a change in illumination from said single lamp to said lamps.

2. The reaction time enhancer of claim 1 wherein said frame means comprises a first frame member for receiving said single lamp and a second frame member extending from said first time member for receiving said lamps.

3. The reaction time enhancer of claim 2 wherein said first frame member extends substantially perpendicularly from said second frame member at substantially the midpoint of said second frame member.

4. A reaction time enhancer for decreasing a user's reaction time in aiming a firearm at a moving target, comprising an elongated horizontal frame member disposed in spaced relationship with respect to the barrel of the firearm; a vertical frame member projecting downwardly from said horizontal frame member; first light-emitting diode carried by said vertical frame member; and a plurality of second light-emitting diodes carried by said horizontal frame member, whereby the aim of the firearm is transferred by the user from said first light-emitting diode to said plurality of second light-emitting diodes responsive to a change in illumination from said first light emitting diode to said plurality of second light-emitting diodes.

5. The reaction time enhancer of claim 4 wherein said first light-emitting diode has a first selected color and said plurality of second light-emitting diodes each have a second selected color different from said first selected color.

6. A reaction time enhancer for decreasing a user's reaction time in aiming a firearm at a moving target, comprising a first frame member disposed in spaced relationship with respect to the firearm; an elongated second frame member projecting from said first frame member; a first light-emitting diode carried by said first frame member; and a plurality of second light-emitting diodes carried by said second frame member, whereby the aim of the firearm is transferred by the user from said first light-emitting diode to one of said plurality of second light-emitting diodes and from said one of said plurality of second light-emitting diodes to another of said plurality of second light-emitting diodes, responsive to a change in illumination from said first light-emitting diode to said one of said plurality of second light-emitting diodes and from said one of said plurality of second light-emitting diodes to said another of said plurality of second light-emitting diodes.

7. The reaction time enhancer of claim 6 wherein said single light-emitting diode has a first selected color and said plurality of second light-emitting diodes each have a second selected color different from said first selected color.

* * * * *